US009388751B2

(12) United States Patent
Chong

(10) Patent No.: US 9,388,751 B2
(45) Date of Patent: Jul. 12, 2016

(54) ENGINE SPEED DETERMINATION BY GEAR CASTELLATION

(71) Applicant: Perkins Engines Company Limited, Peterborough (GB)

(72) Inventor: Yi Wei Chong, South Witham (GB)

(73) Assignee: Parkins Engines Company Limited, Peterborough (GB)

( * ) Notice: Subject to any disclaimer, the term of this patent is extended or adjusted under 35 U.S.C. 154(b) by 195 days.

(21) Appl. No.: 14/328,320

(22) Filed: Jul. 10, 2014

(65) Prior Publication Data

US 2014/0318495 A1 Oct. 30, 2014

(51) Int. Cl.

| | |
|---|---|
| ***F02B 3/00*** | (2006.01) |
| ***F02D 29/02*** | (2006.01) |
| ***F02D 41/00*** | (2006.01) |
| ***F02M 37/06*** | (2006.01) |
| ***F02M 37/14*** | (2006.01) |

(52) U.S. Cl.

CPC ..... *F02D 29/02* (2013.01); *F02D 41/0097* (2013.01); *F02M 37/06* (2013.01); *F02M 37/14* (2013.01)

(58) Field of Classification Search

CPC . F02D 41/0097; F02D 41/009; F02D 41/401; F02D 2200/101; F02D 29/02; F02B 3/06; Y02T 10/44; F02M 37/041; F02M 37/06; F02M 37/14

USPC ..... 701/110; 73/114.25, 114.26; 123/436, 123/406.58, 406.59, 406.61, 406.62, 687, 123/494, 90.15, 90.31, 198 C

See application file for complete search history.

(56) References Cited

U.S. PATENT DOCUMENTS

| | | | | | |
|---|---|---|---|---|---|
| 4,417,469 | A * | 11/1983 | Stevenson | F02D 1/18 | 123/501 |
| 4,879,985 | A * | 11/1989 | Day | F02D 41/009 | 123/501 |
| 6,415,758 | B1 * | 7/2002 | Pierro | F01L 1/024 | 123/195 R |
| 2004/0107940 | A1 * | 6/2004 | Elliott | F01M 1/02 | 123/198 C |
| 2010/0043750 | A1 * | 2/2010 | Lysinger | F02D 41/009 | 123/406.58 |
| 2015/0033893 | A1 * | 2/2015 | Bell | F16C 3/02 | 74/434 |

* cited by examiner

*Primary Examiner* — Hai Huynh
*Assistant Examiner* — Gonzalo Laguarda

(57) ABSTRACT

A speed-determining system in an internal combustion engine is disclosed. The internal combustion engine includes a crankshaft, a camshaft, and an engine control module (ECM). The system includes a first gear that rotates with the crankshaft and a second gear attached to the camshaft. At least one idler gear is operatively meshed with the first gear and the second gear. A fuel pump gear, meshed with the idler gear, is driven proportionally to the first gear and the second gear. The fuel pump gear includes a transversal face, a circumferential lip portion, and a number of notches along the circumferential lip portion. A proximity sensor, in communication with the ECM, is spaced from the second gear. A rotation of the fuel pump gear moves the notches relative to the proximity sensor, triggering the proximity sensor to register movement of the fuel pump gear and calculate at least a camshaft speed.

1 Claim, 3 Drawing Sheets

ENGINE SPEED DETERMINATION BY GEAR CASTELLATION

TECHNICAL FIELD

The present disclosure relates generally to a speed-determining system for an internal combustion engine. More specifically, the present disclosure relates to calculating a speed of an engine camshaft based on a speed measurement of an auxiliary gear.

BACKGROUND

Internal combustion engines are used in machines to power various applications. Excess fuel consumption affects operational efficiencies in such engines. Accordingly, timing of fuel intake valves and related operational profiles are arranged so as to provide optimum engine efficiency. More particularly, it is desirable to optimize valve timings and valve operational profiles to help attain an efficient inflow of an air-fuel mixture or compressed air charge into the internal combustion engine. Such valve timing parameters generally depend upon a camshaft speed. Accordingly, a speed at which a camshaft runs is generally monitored and related operational profiles are derived.

Conventional methods to acquire a camshaft speed generally include gauging a rotary speed of the camshaft by a cam speed sensor. Cam speed sensors help in determining a gear motion, a camshaft rotation, and, in effect, facilitate deduction of the optimum valve-timing profiles. In deployment, cam speed sensors may typically be positioned relatively close to the camshaft. In some engine configurations, such regions may be exposed to relatively high temperatures during engine operation, which may cause sensor inaccuracies. In many cases, the cam speed sensors may malfunction and may require repairs or replacement.

SUMMARY OF THE INVENTION

Various aspects of the present disclosure are directed to a speed-determining system in an internal combustion engine. The internal combustion engine includes a crankshaft, a camshaft, and an engine control module (ECM). The camshaft rotates at a speed less than that of the crankshaft. The speed-determining system includes a first gear structured and arranged to rotate with the crankshaft in a first angular direction. At least one idler gear is operatively meshed to the first gear and rotates in an opposite angular direction to the first angular direction. Further, a second gear is fixedly attached with the camshaft. The second gear is meshed with the idler gear and rotates proportionally to the first gear in the first angular direction. A rotation of the second gear enables a rotation of the camshaft. A fuel pump gear rotates about a rotational axis and is meshed with the at least one idler gear. The fuel pump gear is driven proportionally to both the first gear and the second gear, in the first angular direction. The fuel pump gear includes a transversal face, a circumferential lip portion extending around the transversal face, and a number of notches provided along the circumferential lip portion. Moreover, a proximity sensor is in communication with the ECM and is positioned substantially parallel to the rotational axis. The proximity sensor is spaced from the second gear and faces the circumferential lip portion. A rotation of the fuel pump gear facilitates a movement of the notches relative to the proximity sensor. Such an operation triggers the proximity sensor to register movement of the fuel pump gear. A speed of the fuel pump gear is measured based on the movement of the fuel pump gear, which enables the ECM to calculate at least a speed of the camshaft.

DETAILED DESCRIPTION

Figure 1:
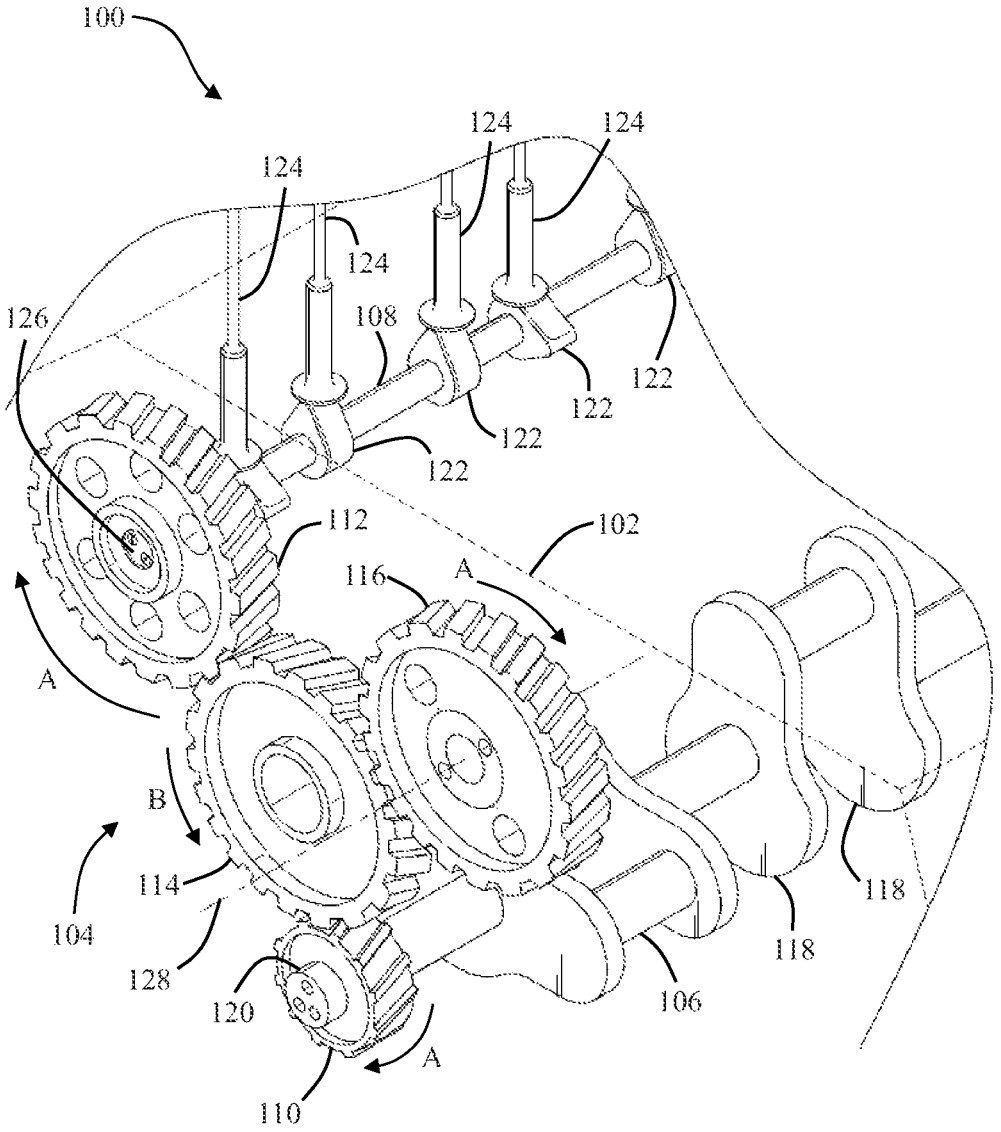
FIG. 1 is a partial front isometric view of an exemplary layout of an engine, in accordance with the concepts of the present disclosure.

Referring to FIG. 1, an exemplary engine layout 100 of an internal combustion engine 102, (hereinafter referred to as engine 102), is shown. The engine 102 may be for use in machines (not shown) such as, but not limited to, mining trucks, track-type tractors, excavators, wheel loaders, and/or the like. Applicability in stationary machines, such as power generation systems and other electric power generating machines is also envisioned. Moreover, the concepts of the present disclosure may be applicable to any machine that uses internal combustion engines for power generation. The engine 102 includes a front end 104, a crankshaft 106 and a camshaft 108. A first gear 110 is connected to the crankshaft 106, while a second gear 112 is connected to the camshaft 108. An idler gear 114 is operatively meshed with both the first gear 110 and the second gear 112. Additionally, a fuel pump gear 116 is meshed with the idler gear 114.

The crankshaft 106 may be selected from one of the widely employed crankshafts available. The crankshaft 106 may include a number of counterweights 118, as depicted. The counterweights 118 may be positioned serially to correspond to a piston-connecting rod arrangement (not shown), and may balance out a reciprocating mass of each of the piston-connecting rod arrangements, during operation. Configuration and positions of the counterweights 118 may depend upon a firing cycle of the engine 102. The crankshaft 106 rotates in a first angular direction, A. At one end, the crankshaft 106 defines a crankshaft end 120.

The camshaft 108 may be any of the widely employed camshaft units. The camshaft 108 may include a number of cams 122, arranged along a longitudinal length of the camshaft 108. As is conventionally known, a pair of cams 122 may be associated with each cylinder (not shown) of the engine 102. Also, each cam 122 may abut against a follower or a lifter-pushrod arrangement 124, to operate valves of the engine 102, according to a preset pattern. At one end, the camshaft 108 defines a camshaft end 126.

The first gear 110 is structured and arranged to rotate with the crankshaft 106 in a first angular direction, A. The first gear 110 is arranged at the crankshaft end 120. Although not limited, the first gear 110 may be a helical gear, which may restrict axial movement when engaged with one or more adjacent gears. The first gear 110 may be mounted at the crankshaft end 120 using one of bolted, threaded, and/or press-fit connections, which are known to those having ordinary skill in the art.

The idler gear 114 may be mounted to the engine 102 at a suitable location and may be configured to freely rotate with respect to the engine 102. Because the idler gear 114 is operatively meshed with the first gear 110, a counter-drive movement to the idler gear 114 is imparted in an opposite angular direction B, relative to the first angular direction A. Such a provision may facilitate a reverse rotation of certain adjoining/affiliated components of the engine 102, in relation to the movement of the first gear 110 (or the crankshaft 106). Although other means of connection may be contemplated, connection of the idler gear 114 to the engine 102 may constitute bolted, threaded, and/or press-fit connections, as is customary in the art. A size of the idler gear 114 may be independent of a size of the first gear 110.

The second gear 112 is fixedly attached to the camshaft 108. More particularly, the second gear 112 is arranged at the camshaft end 126, and is operatively meshed with the idler gear 114. In that manner, the second gear 112 is configured to rotate directly proportionally to the first gear 110, in the first angular direction, A. Notably, a rotation of the second gear 112 enables a rotation of the camshaft 108. Although not limited, a size of the second gear 112 may be larger than the size of the first gear 110. Accordingly, the camshaft 108 may rotate at a reduced speed as compared to the speed of the crankshaft 106. In an exemplary embodiment, a diameter of the second gear 112 may be twice that of the first gear 110. In such a configuration, the second gear 112 may rotate at half the speed of the first gear 110. By implication, the camshaft 108 may rotate at half the speed of the crankshaft 106 and may comply with the different cycles of intake, compression, expansion, and exhaust, of the engine 102. Connections of the second gear 112 to the camshaft end 126 may include provisions as already noted for the first gear 110 and the idler gear 114.

The fuel pump gear 116 is operatively meshed with the idler gear 114 as well, and is configured to rotate about a rotational axis 128. As with the second gear 112, the first gear 110 drives the fuel pump gear 116 via the idler gear 114. Accordingly, the fuel pump gear 116 is driven substantially proportionally to both the first gear 110 and the second gear 112, in the first angular direction, A. In an embodiment, a diameter of the fuel pump gear 116 may be equal to the diameter of the second gear 112. A resultant angular speed of the camshaft 108, therefore, may match and be synchronous with the movement of the fuel pump gear 116. In this manner, the camshaft speed may be gauged by monitoring the fuel pump gear 116.

Sizes of the fuel pump gear 116 and second gear 112 may differ. In such instances, calculations may be sought, and a camshaft speed may be derived, based on a ratio of the size existing between the second gear 112 and the fuel pump gear 116. To comply with the first gear 110, the second gear 112, idler gear 114, and the fuel pump gear 116, may be helical gears, as well. Nevertheless, other configurations may be envisioned without limiting the scope of the present disclosure.

Figure 2:
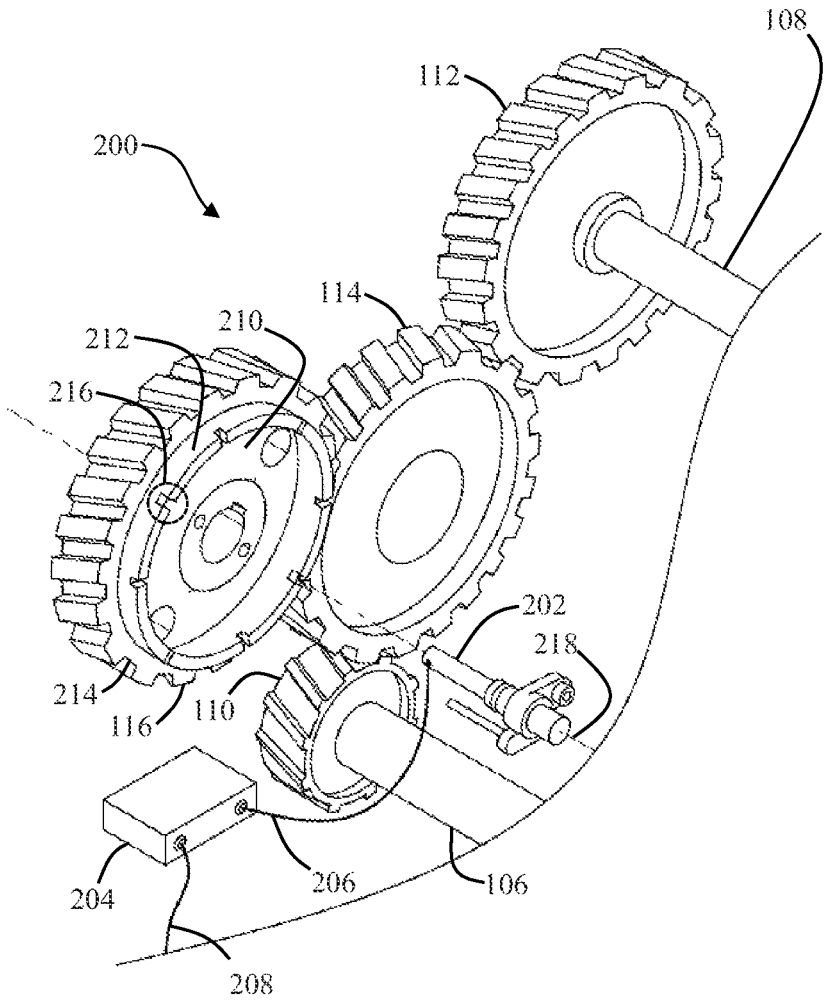
FIG. 2 is a partial rear isometric view of FIG. 1, depicting a scheme of an exemplary speed-determining system, in accordance with the concepts of the present disclosure.

Referring to FIG. 2, an exemplary schematic of a speed-determining system 200 is shown. In general, a speed determination carried out in the engine 102 (shown in FIG. 1) involves determining a speed of the camshaft 108, according to the present disclosure. The speed-determining system 200 includes an application of the fuel pump gear 116, a proximity sensor 202, and an engine control module (ECM) 204. Here, the application of the fuel pump gear 116 includes use of a rear face of the fuel pump gear 116, which is deployed towards the engine 102. The rear face may be understood when FIG. 2 is seen in conjunction with FIG. 1. A first cabled lead 206 and second cabled lead 208 form connections within the speed-determining system 200.

In further detail, the rear face of the fuel pump gear 116 may be referred to as a transversal face 210 due to extending transversely with respect to the rotational axis 128 of the fuel pump gear 116. The transversal face 210 is generally a planar surface. The transversal face 210 includes a circumferential lip portion 212 that extends around the transversal face 210. In addition, the circumferential lip portion 212 projects outward from the transversal face 210, in a direction parallel to the rotational axis 128 of the fuel pump gear 116, towards the engine 102 (shown in FIG. 1). The circumferential lip portion 212 may be a raised structure formed substantially at the periphery of the fuel pump gear 116. More particularly, the circumferential lip portion 212 may be formed relatively adjacent to a root circle 214 of the fuel pump gear 116. The circumferential lip portion 212 may be made integrally from the same material as that of the fuel pump gear 116. Although not limited, an outward extension of the circumferential lip portion 212 may be smaller than a radius of the fuel pump gear 116. For example, the circumferential lip portion 212 may be less than 2.54 centimeters. Furthermore, the circumferential lip portion 212 may include a relative thickness, defined consistently along a circular profile of the transversal face 210.

A set of gear castellations, referred to as a number of notches 216, may be provided along the circumferential lip portion 212. The notches 216 may be cut-outs defined on the circumferential lip portion 212. Such cut-outs may be formed via well known methods, such as those involving shaping and milling operations. Other methods may be contemplated. Although not limited, the cut-outs of the notches 216 may include rectangular-shaped cross sectional profiles. Additionally, the notches 216 may be equally spaced from each other.

In an embodiment, each notch, among the number of notches 216 may have a characteristic color. Accordingly, an exemplary speed sensing process may include sensing each of the characteristic color. A corresponding gear rotation may be established when a color repeats itself. Alternatively, an array of protrusions, grooves, spikes, other physically recognizable features, or a combination of these, may be contemplated in lieu of the number of notches 216.

The proximity sensor 202 may be a cam speed sensor configured to register a notch movement. The proximity sensor 202 may be selected from one of the widely employed hall-effect sensors known in the art. Other sensor types may be contemplated without limiting the scope of the present disclosure. The proximity sensor 202 may be spaced from the second gear 112. The proximity sensor 202 may optically face the circumferential lip portion 212, and accordingly, be fixedly deployed in relation to the notches 216. More specifically, the proximity sensor 202 includes a longitudinal axis 218, which provides a line of sight upon which measurements may be taken. During a speed-sensing procedure, a position of the proximity sensor 202, relative to the circumferential lip portion 212, may be such that each notch 216 passes through the longitudinal axis 218. Additionally, placement of the proximity sensor 202 is such that the longitudinal axis 218 is substantially parallel to the rotational axis 128 of the fuel pump gear 116. In that manner, the proximity sensor 202 is capable of sensing a movement of the fuel pump gear 116 based on the passing of the notches 216 through the longitudinal axis 218. Each sensed occurrence of a notch 216 is registered as a signal. The proximity sensor 202 is in communication with the ECM 204. Accordingly, each sensed signal is then converted to a format to be read by the ECM 204. When the notches 216 are provided with characteristic colors, as disclosed above, optical sensors may be used to determine a gear rotation.

The ECM 204 is configured to receive the sensed signals from the proximity sensor 202. The ECM 204 may include microprocessors to process those received signals and store a set of processed signals in a memory. In addition to handling multiple actuation processes for the engine 102 (shown in FIG. 1), the ECM 204 may also include provisions to calculate speed of the camshaft 108. Accordingly, related algorithms that can deduce a camshaft speed may be installed in non-volatile memory locations within the ECM 204. Moreover, the ECM 204 may include a set of non-volatile and volatile memory units such as RAMs/ROMs, which include associated input and output buses. The ECM 204 may also be envisioned as an application-specific integrated circuit, or a logic device, which provides controller functionality. Timing counters configured within the ECM 204 may track time. In an embodiment, the ECM 204 may be configured to send processed speed information to a machine operator via a feedback interface (not shown).

A first cabled lead 206 conductively connects the proximity sensor 202 to the ECM 204, and may facilitate a transfer of the sensed signals from the proximity sensor 202 to the ECM 204. A second cabled lead 208 extends from the ECM 204 to conductively connect other portions of the engine 102. Connections that extend to externally located logic devices are also envisioned.

Figure 3:
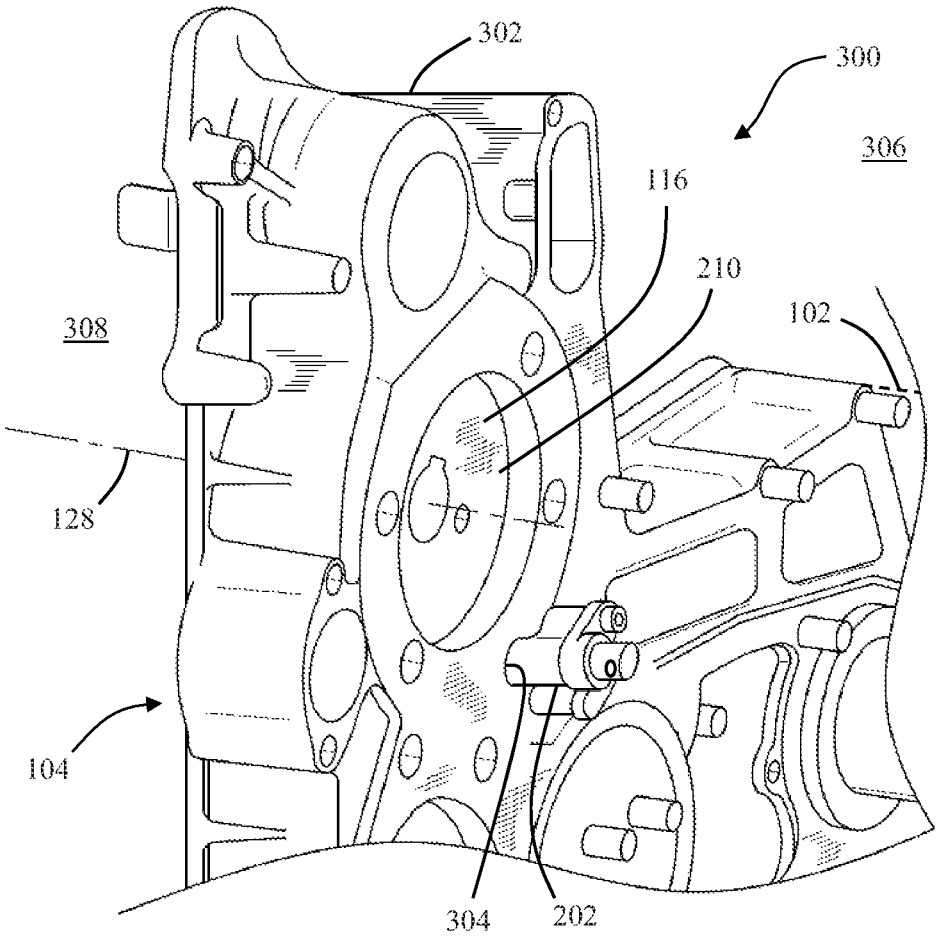
FIG. 3 is a perspective view of the speed-determining system of FIG. 2 installed into a timing case, in accordance with the concepts of the present disclosure.

Referring to FIG. 3, an assembled view of a portion 300 of the engine 102 is shown. The portion 300 includes a timing case 302 designed and configured to seal the front end 104 of the engine 102. As the name implies, the timing case 302 facilitates encasement of some components that may determine timing profiles for the engine 102. Notably those components may include the fuel pump gear 116 and at least a part of the proximity sensor 202, discussed above. More particularly, the portion 300 houses and protects those components from an external environment. Accordingly, the timing case 302 may define inner and outer peripherals to accommodate the fuel pump gear 116 and the proximity sensor 202.

A deployment of the proximity sensor 202 relative to the fuel pump gear 116 is enabled by having the proximity sensor 202 mounted to the timing case 302. For that purpose, the timing case 302 includes a mounting region 304 to which the proximity sensor 202 may be removably secured. Such securing measures may include threaded connections, snap-fit connections, and/or the like.

INDUSTRIAL APPLICABILITY

Typically, the speed of an internal combustion engine, such as the engine 102, may be determined based on the speed of the camshaft 108. Sensors used for this purpose may be mounted on the right hand side (RHS) 306 of the engine 102, i.e. towards the exhaust outlet (not shown) of the engine 102. Owing to the presence of components such as a turbocharger, exhaust manifold, (not shown) etc., the temperature on the RHS 306 is often higher when compared to the left hand side (LHS) 308 of the engine 102. As a result, sensitivity and life of the speed sensors may be considerably affected. Additionally, there may be space constraints to effectively route electrical harness lines, near the front side of the RHS 306. The disclosure set out below describes an exemplary operational procedure of the speed-determining system 200 to determine the engine speed based on the speed of an auxiliary gear placed on the LHS 308 of the engine 102.

During operations, angular rotational crankshaft movement causes the first gear 110 to rotate. Consequently, the first gear 110 turns the idler gear 114. The movement of the idler gear 114 in turn drives both the second gear 112, and the fuel pump gear 116. As a result, the circumferential lip portion 212 formed on the fuel pump gear 116 rotates. Notches 216 around the circumferential lip portion 212 may then move relative to the proximity sensor 202 so as to trigger the proximity sensor 202 to register a rotation of the fuel pump gear 116. As each notch 216 moves, a magnetic field may be generated and an Alternating Current (AC) voltage pulse may be induced within the proximity sensor 202. As the fuel pump gear 116 rotates faster, more pulses may be produced. The proximity sensor 202 may sense each rotation and convert the registered rotations into corresponding signals readable by the Engine Control Module (ECM) 204. The proximity sensor 202 may then deliver each rotation pulse to the ECM 204.

Upon receipt of the sensed signals, the ECM 204 may convert the received data into a readable format for computations within the set of ECM microprocessors. Algorithms installed within the ECM 204 may help deduce a speed of the fuel pump gear 116 based on the converted data. More specifically, the ECM 204 may determine the speed at which the fuel pump gear 116 rotates, based on the number of pulses obtained. Based on the movement of the fuel pump gear 116, the rotational speed of the camshaft 108 may be deduced. The ECM 204 may store and record the measured data. The second cabled lead 208 may then transfer the data to other logic devices, facilitating deduction and optimization of valve-timing profiles.

As an exemplary sensing procedure, if there are 10 notches structured on the circumferential lip portion 212, completion of one full rotation would imply that the proximity sensor 202 would have sensed movement up to 11 notches. Corresponding to every $11^{th}$ notch, therefore, a full rotation of the fuel pump gear 116 may be registered. From the $11^{th}$ notch onwards, the proximity sensor 202 may initiate registration of a subsequent rotation. Timers associated with the ECM 204 may simultaneously compute the time taken to complete the rotations. For example, the number of pulses sensed in one second may establish a signal frequency, and thus, a camshaft speed. Such frequency computations may be delivered in multiple units as well, for example, as rotations per minute (RPM).

The substantial axial positioning of the proximity sensor 202 limits an affect of the relatively high temperature conditions of the RHS 306 on the speed-determining system 200. Further, such positioning imparts a relatively close packed configuration as well. With the given arrangement, extensions to a shaft of the fuel pump gear 116 and other space consuming features to deduce an engine speed, may be avoided. Effectively, the speed-determining system 200 is kept from acquiring a bulky, complex, and space consuming arrangement.

In an embodiment, the stored data may be accessible through online portals that may be configured to receive such input. Optionally, data may be transferred to periodic registering logs within the ECM 204, to be retrieved for later use. During testing and inspection, for example, one may readily receive an engine speed data from those logs via a connected laptop or workstation.

The ECM 204, in effect, calculates an engine speed that involves the camshaft. Once the speed of the camshaft 108 is determined, an engine speed that involves a speed of the crankshaft 106 may be established as well. This is because a size of the first gear 110, and the second gear 112, may be calculated or may be known to possess a fixed ratio.

It should be understood that the above description is intended for illustrative purposes only and is not intended to limit the scope of the present disclosure in any way. Those skilled in the art will appreciate that other aspects of the disclosure may be obtained from a study of the drawings, the disclosure, and the appended claim.

What is claimed is:

1. A speed-determining system in an internal combustion engine, the internal combustion engine including a crankshaft, a camshaft, and an engine control module (ECM), the camshaft rotating at a reduced speed of the crankshaft, the system comprising:

a first gear structured and arranged to rotate with the crankshaft in a first angular direction;

at least one idler gear operatively meshed to the first gear and rotating in an opposite angular direction to the first angular direction;

a second gear fixedly attached to the camshaft, meshed with the at least one idler gear, and rotating proportionally to the first gear in the first angular direction, wherein a rotation of the second gear enables a rotation of the camshaft;

a fuel pump gear rotating about a rotational axis and meshed with the at least one idler gear, thereby being driven proportionally to both the first gear and the second gear, in the first angular direction, wherein the fuel pump gear includes:

a transversal face;

a circumferential lip portion extending around the transversal face;

a plurality of notches provided along the circumferential lip portion; and a proximity sensor in communication with the ECM, positioned substantially parallel to the rotational axis, spaced from the second gear and facing the circumferential lip portion, wherein:

a rotation of the fuel pump gear facilitates a movement of the plurality of notches relative to the proximity sensor, thereby triggering the proximity sensor to register a movement of the fuel pump gear, wherein:

a speed of the fuel pump gear is measured based on the movement of the fuel pump gear, thereby enabling the ECM to calculate at least a speed of the camshaft.

* * * * *